United States Patent [19]

Hart et al.

[11] 4,302,877

[45] Dec. 1, 1981

[54] SINGLE SPRING DOUBLE LOCKBLADE FOLDING KNIFE

[75] Inventors: Thomas D. Hart; David J. Hart, both of Bradford, Pa.

[73] Assignee: W. R. Case & Sons Cutlery Company, Bradford, Pa.

[21] Appl. No.: 149,278

[22] Filed: May 12, 1980

[51] Int. Cl.[3] ..... B26B 1/00
[52] U.S. Cl. ..... 30/161
[58] Field of Search ..... 30/160, 161, 155

[56] References Cited

U.S. PATENT DOCUMENTS 988,068 3/1911 Beardsley ..... 30/161
1,341,153 5/1920 Parker ..... 30/161 X

*Primary Examiner*—Jimmy C. Peters
*Attorney, Agent, or Firm*—Pennie & Edmonds

[57] ABSTRACT

A foldable knife is provided having two lock blades each of which or both of which simultaneously may be locked in their open position against movement in either direction about their respective pivots. A separate locking member and tumbler is provided for each blade but only a single spring is utilized to operate both locking members and urge them toward their locked position.

9 Claims, 5 Drawing Figures

SINGLE SPRING DOUBLE LOCKBLADE FOLDING KNIFE

BACKGROUND OF THE INVENTION

1. Field of the Invention

This invention relates to the field of foldable knives and, in particular, to foldable knives in which the blade when extended is locked in place against movement in either direction about its pivot until such lock is manually disengaged. Still more specifically, the present invention is directed to such a foldable knife in which two lockblades are provided.

2. Prior Art

Foldable knives having a single lockblade are known. One such lockblade knife is shown in U.S. Pat. No. 1,362,142. The knife disclosed in U.S. Pat. No. 1,362,142 includes one lockblade and a second non-lockable blade. Due to the bulk size of the locking mechanism for a lockblade, there has not, prior to the present invention, been available a foldable knife having two lockblades so fas as is known to the present applicants.

BRIEF SUMMARY OF THE INVENTION

The present invention is directed to the construction of a foldable knife having an elongated handle with a lockblade pivoted adjacent each handle end. A pivoted locking member is provided for each blade, each of which locking blade members includes a tumbler which fits into a notch in the blade when the blade is in its open position. When the tumbler is fitted into the cooperating notch in the blade, the blade may not be moved in either direction about its pivot but is securely locked open. By applying manual pressure to the end of the locking member opposite to the tumbler, the tumbler may be moved out of locking engagement with the blade notch, whereupon the blade may be moved to its closed position. A single elongated spring is also pivoted within the handle at a point adjacent its center. Each of the opposite ends of the spring bears against one of the locking members whereby both locking members are urged by the spring toward their locked position.

By the use of short locking members and a fairly strong pivoted spring, it has been possible to provide for two lockblades in a single foldable knife.

DETAILED DESCRIPTION OF THE PREFERRED EMBODIMENT

Figure 1:
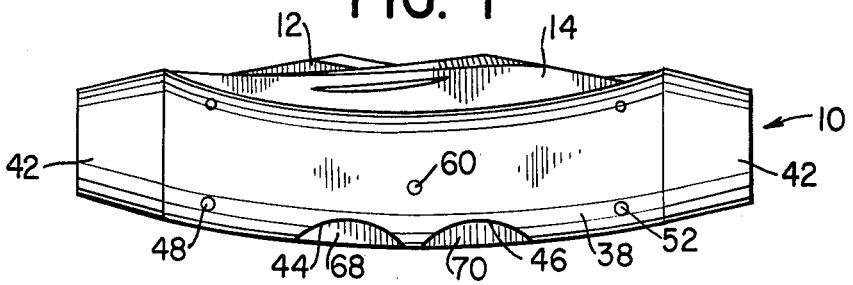
FIG. 1 shows a side elevation of the knife of this invention.
Figure 2:
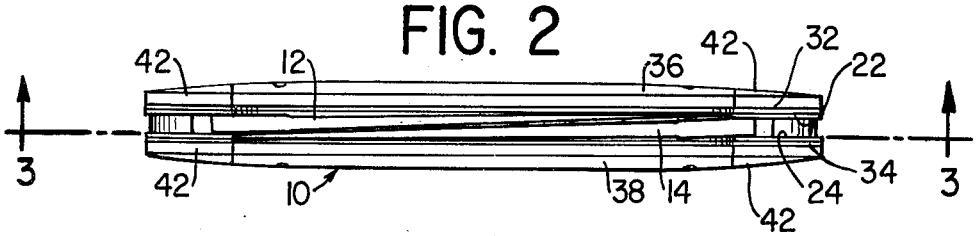
FIG. 2 shows a top plan view of the knife of FIG. 1.

As shown in the figures, the knife has an elongated handle 10 and two blades 12 and 14 pivoted to the handle at 16 and 18 respectively. Immediately toward the outside of blade 12 is a side plate 22 cut away toward the center thereof as shown at 26. An identical plate 24 shown only in FIG. 2 is positioned immediately outside of blade 14. Immediately outside of plates 22 and 24 are side plates 32 and 34 respectively which are not so cut out. Decorative finish plates 36 and 38 are riveted to the outside of the plates 32 and 34 respectively. Four bolsters 42, usually chrome finished, are positioned as shown on both sides of the knife and at both ends of the finish plates 36 and 38. The plates 22, 24, 32, 34, 36 and 38 are all notched on the back of the knife at 44 and 46 for purposes hereinafter apparent.

The pivots 16 and 18 for the blades 12 and 14 respectively extend through the plates 22, 24, 32, 34 and may, if desired, also extend into the adjacent bolsters 42.

Figure 4:
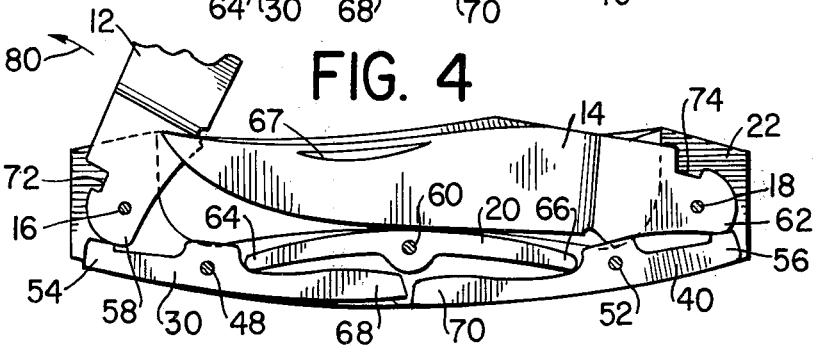
FIG. 4 is a view similar to FIG. 3, in which the blade to the left in the figure is in transit between its closed and open position.

Also pivoted within the handle 10 are two locking members 30 and 40. The members 30 and 40 are generally elongated levers pivoted adjacent their centers at 48 and 52 respectively. The locking members 30 and 40 are in general longitudinal alignment with each other. Each of the locking members 30 and 40 has on its outer end a tumbler 54 and 56 respectively, which tumblers 54 and 56 in the closed position of the blades as shown in FIG. 4 bear against a portion of the base 58, 62 respectively of its respective blade 12, 14.

Pivotally mounted at 60 in the handle and in alignment with the locking members 30 and 40 is a spring 20. The outer ends 64, 66 of which bear against the locking members 30, 40 respectively. It will be seen that the spring 20 contacts the locking members 30, 40 on the opposite side of their respective pivots 48, 52 from the tumblers 54, 56. Thus, the locking member 30 is urged in a clockwise direction as viewed in FIG. 3 and the locking member 40 is urged in a counterclockwise direction as viewed in FIG. 3. As will be presently seen, the direction in which the locking members 30 and 40 is urged by the spring 20 is toward the locked position for the locking members 30 and 40. On their inner ends, the locking members 30 and 40 have a portion 68, 70 respectively exposed for manual operation by the user, which manual operation is in the opposite direction for the locking members 30 and 40 from that direction toward which they are normally urged by the spring 20. Each of the blades 12 and 14 also has a notch 72, 74 respectively for receipt of its associated tumbler when in the open position.

Operation

Figure 3:
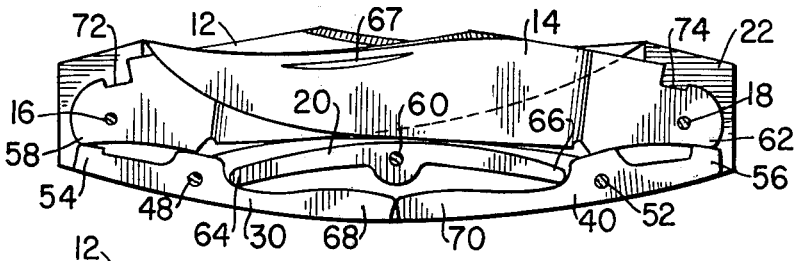
FIG. 3 is a cross-section taken along the line 3—3 of FIG. 2 and showing the knife with both blades folded.

In the normal closed position of the knife as shown in FIG. 3, the tumblers 54, 56 under the urging of spring 20 bear firmly against base portions 58, 62 respectively of blades 12, 14 to retain the blades in their closed position. In this position, the strength of the spring 20 is sufficient to hold the blades 12, 14 closed under all normal conditions; however, manual operation can overcome the urging of the spring 20 to open the knife. FIG. 4 shows the knife with the blade 12 in transition from the closed to the open position. The operator has grasped the blade 12 on its exposed edge utilizing a slot therein (not shown) like the slot 67 shown in blade 14 to aid in gripping the blade. The operator then manually pivots the blade in the direction of arrow 80 which causes the base 58, bearing against tumbler 54, to press the tumbler 54 outwardly, thus rotating the locking member 30 in a counterclockwise direction against the urging of spring 20. The blade 14 may be opened in the opposite direction in the same manner with the base 62 bearing against the tumbler 56 and moving the locking member 40 clockwise against the urging of the spring 20.

Figure 5:
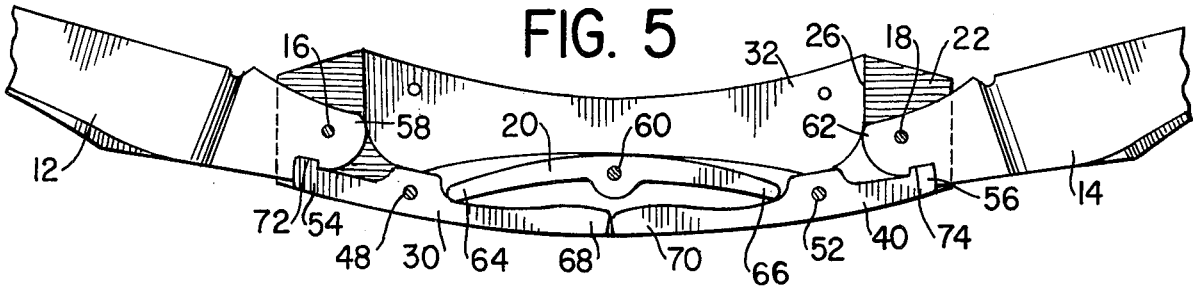
FIG. 5 shows a view similar to FIGS. 3 and 4, in which both blades are in their extended locked positions.

When the blade 12 reaches its fully extended position as shown in FIG. 5, spring 20 pivots the locking member 30 to effect firm engagement of the tumbler 54 in the tumbler receiving notch 72 at the base of blade 12. This position as shown in FIG. 5 firmly locks the blade 12 against rotation in either direction about its pivot 16 due to the respective shapes and engaging surfaces of the tumbler 54 and the notch 72. Similarly, when the blade 14 is extended as shown in FIG. 5, spring 20 bearing against locking member 40 effects firm engagement of its tumbler 56 in the notch 74 of blade 14 to lock blade 14 against movement in either direction about its pivot 18.

When it is desired to close the knife, the operator, making use of the notch 44 in the handle, presses on the end 68 of the locking member 30, thus overcoming the urging of the spring 20 and disengaging the tumbler 54 from the notch 72. After disengagement of the tumbler 54 from the notch 72, the blade 12 may now be rotated back to its closed position. In like manner, blade 14 is closed by pressing upon the end 70 of locking member 40, thus disengaging tumbler 56 from notch 74 whereupon the blade 14 may be pivoted about its pivot 18 back into its closed position.

We claim:

1. In a foldable knife having a handle and two blades pivoted to the handle for movement to and from open and closed positions, the improvement comprising:

(a) a locking member for each of said blades mounted in tandem to said handle for movement to and from locked and unlocked positions; each of said members mounted on separate spaced-apart pivot means and (b) a single spring mounted in said handle for urging both of said locking members toward their locked position.

2. The knife of claim 1, in which each of said locking members has a tumbler, and each of said tumblers in the closed position of its respective blade bearing against a portion of the blade for maintaining the blade in closed position under the force of said spring.

3. The knife of claim 2, in which each of said blades has a tumbler receiving notch, and each of said blades when in its open position receiving the tumbler of its respective locking member within its tumbler receiving notch to prevent movement of said blade relative to said handle.

4. The knife of claim 3, in which each of said locking members has a manually operable lock release for moving its respective tumbler out of its locking engagement with its respective notch upon manual operation of said lock release against the urging of said spring.

5. The knife of claim 4, in which each of said locking members is a lever pivoted in said handle, and in which said tumblers and said lock releases are integral portions of their respective levers.

6. The knife of claim 1, in which each of said locking members has a tumbler, each of said blades has a tumbler receiving notch, and each of said blades when in its open position receiving the tumbler of its respective locking member within its tumbler receiving notch to prevent movement of said blade relative to said handle.

7. The knife of claim 6, in which each of said locking members has a manually operable lock release for moving its respective tumbler out of its locking engagement with its respective notch upon manual operation of said lock release against the urging of said spring.

8. The knife of claim 7, in which each of said locking members is a lever pivoted in said handle, and in which said tumblers and said lock releases are integral portions of their respective levers.

9. The knife of any one of the preceding claims, in which said spring is elongated, said spring is pivoted adjacent its center in said handle, and each of the ends of said elongated spring bears against a locking member.

* * * * *